US005601350A

United States Patent [19]

Röck et al.

[11] Patent Number: 5,601,350

[45] Date of Patent: Feb. 11, 1997

[54] SUPPORT RAIL FOR A DRAWER PULL OUT GUIDE

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 392,504

[22] Filed: Feb. 23, 1995

[30] Foreign Application Priority Data

Feb. 25, 1994 [AT] Austria ..... 397/94

[51] Int. Cl.[6] ..... A47B 88/00

[52] U.S. Cl. ..... 312/334.1; 312/348.1

[58] Field of Search ..... 312/330.1, 334.1, 312/334.6, 334.7, 334.4, 334.27, 348.1

[56] References Cited

U.S. PATENT DOCUMENTS 4,199,200 4/1980 Livingston .
4,438,994 3/1984 Davis .
4,681,381 7/1987 Sevey .
5,262,923 11/1993 Batta et al. ..... 312/334.7

FOREIGN PATENT DOCUMENTS 843463 5/1952 Germany .
0415212 5/1947 Italy ..... 312/330.1

*Primary Examiner*—Peter M. Cuomo
*Assistant Examiner*—Gerald A. Anderson
*Attorney, Agent, or Firm*—Wenderoth, Lind & Ponack

[57] ABSTRACT

A support rail of a drawer pull-out guide is attachable to an article of frame furniture having a frame front with vertical and horizontal frame members. The support rail is fastened at a front end thereof to a vertical frame member and has at such front end a clamping device which is formed into a U-shape to embrace the vertical frame member.

12 Claims, 9 Drawing Sheets

SUPPORT RAIL FOR A DRAWER PULL OUT GUIDE

BACKGROUND OF THE INVENTION

The invention relates to a support rail of a drawer pull-out guide for use with an article of frame furniture including a front frame having vertical and horizontal frame members, the supporting rail being fastenable at a front end thereof to a vertical frame member.

In furniture constructions, cabinets with drawers are known, where a furniture carcass is provided at a front thereof with a frame which carried furniture fittings. Hinges for a door as well as support rails of pull-out guide fittings for the drawers are fastened to such frame. The term front refers to the side of the article of furniture which faces the user.

OBJECT OF THE INVENTION

The object of the invention is to provide a support rail to be fastened to a furniture frame and having structure enabling a rapid fastening of the support rail without machining (drilling, cutting) of the furniture frame.

SUMMARY OF THE INVENTION

The above object is achieved according to the invention in that the support rail is provided at a front end therewith a clamping device or configuration that may be caused in a U-shaped manner to embrace a frame member of the furniture frame. Advantageously the support rail has a vertical fastening web with at least one stop web which projects at a right angle and which with the support rail in its assembled position rests from the front against a frame member of the furniture frame. The fastening web is provided with at least one retaining member which may be pressed against a rear face of the frame member so that the frame member may be clamped between the stop web and the retaining member.

DETAILED DESCRIPTION OF THE INVENTION

Figure 1:
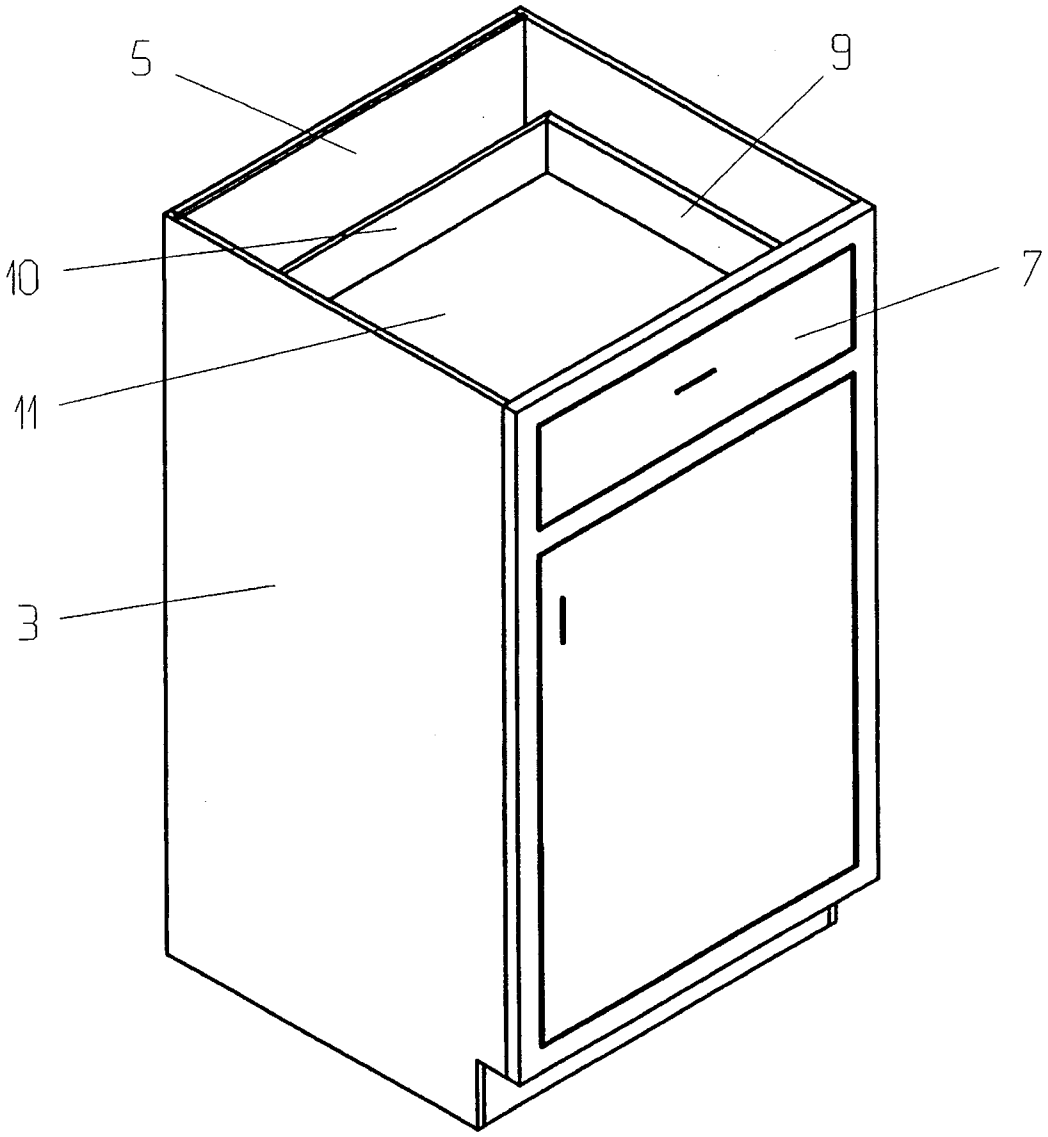
FIG. 1 is a perspective view of a cabinet.
Figure 2:
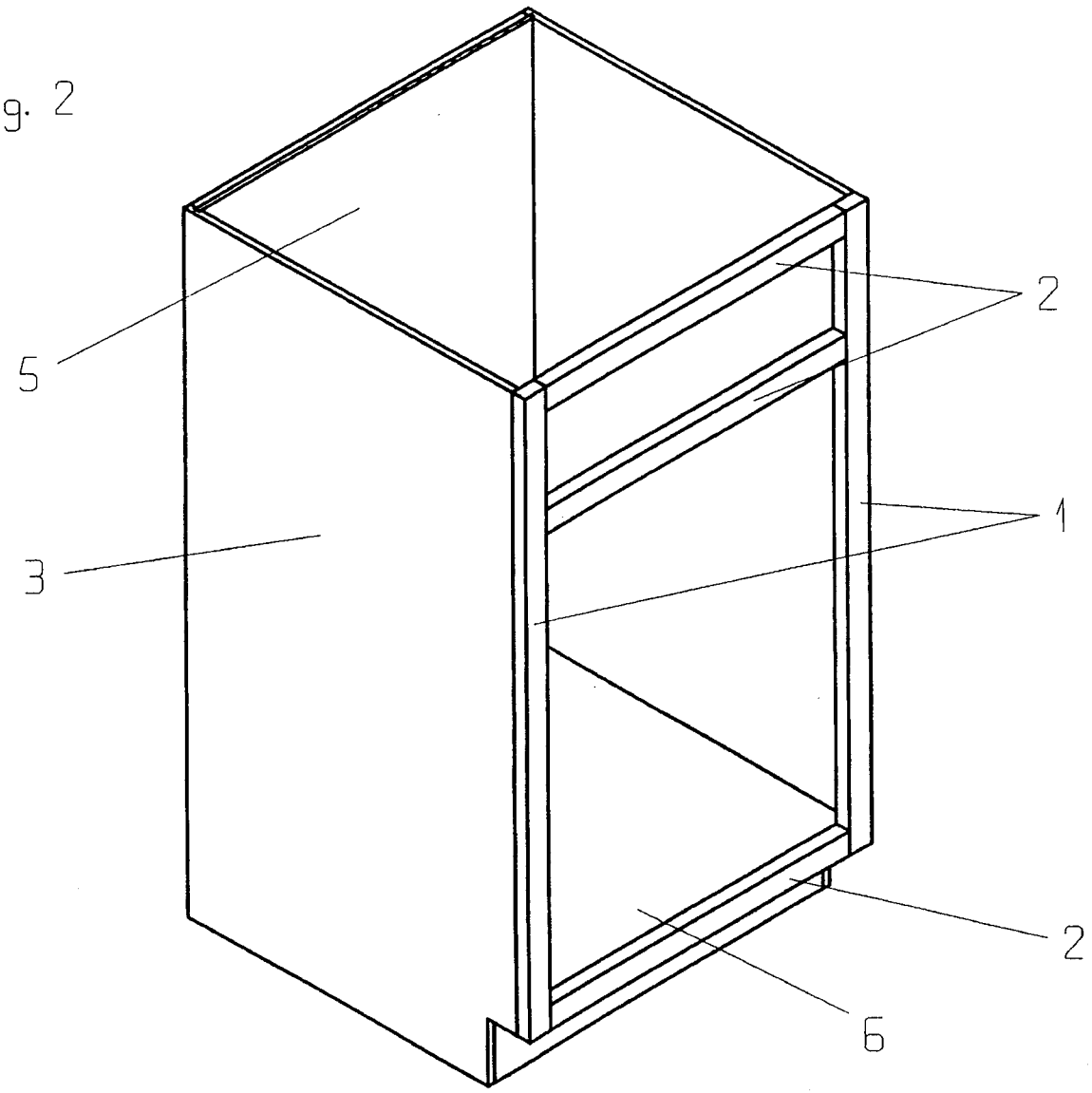
FIG. 2 is a perspective view of a carcass of the cabinet.
Figure 3:
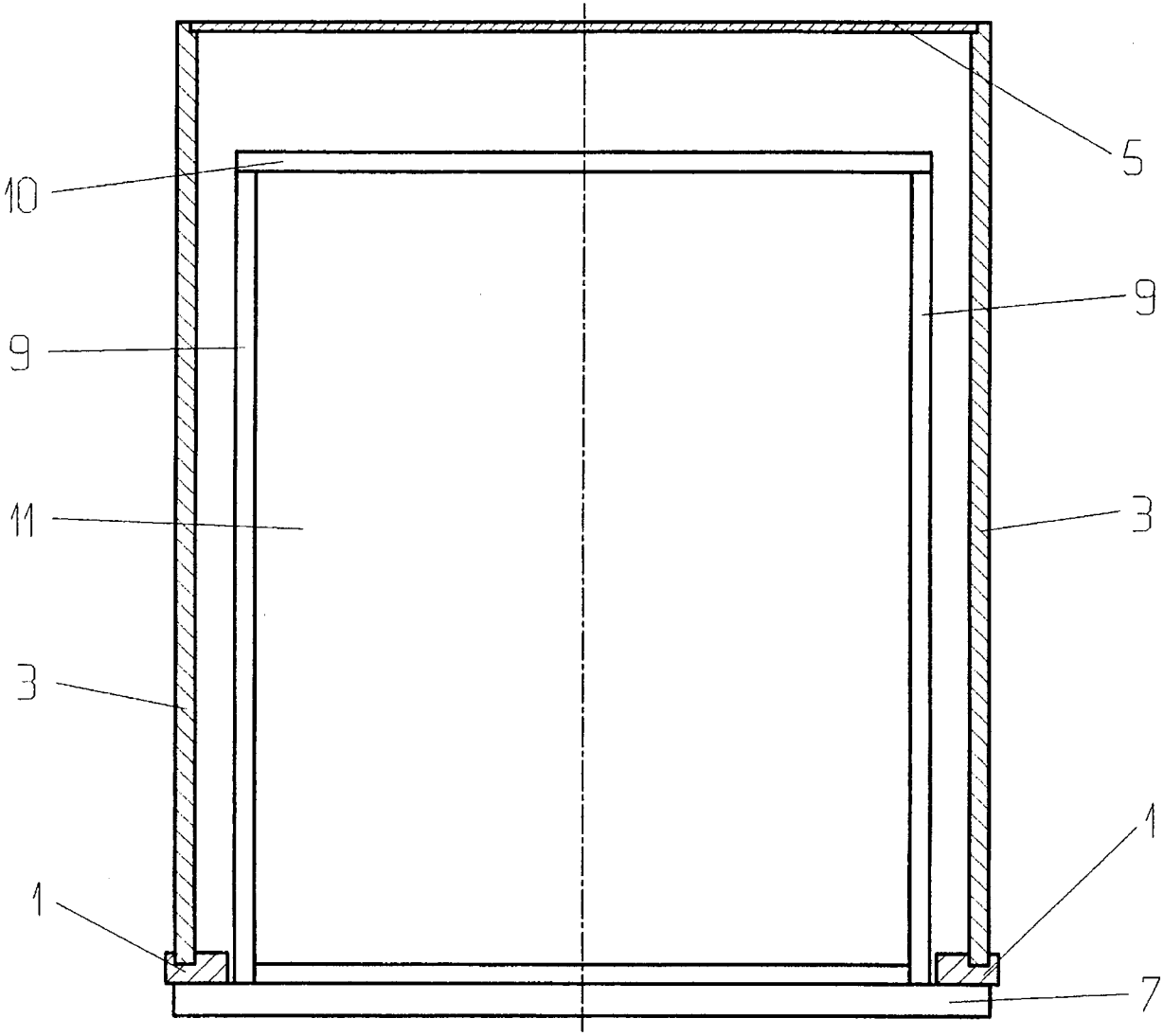
FIG. 3 is a horizontal section through the cabinet.

A furniture carcass has two side panels 3 and a back panel 5. At the front, the side panels 3 are covered by vertical frame members 1 of a front frame. Respective horizontal frame members 2 are provided above and below a drawer opening. The drawer in a conventional manner includes two sides 9, a front panel 7, a drawer base 11 and a rear wall 10. Disposed on each side of the drawer is a pull-out rail, by means of which the drawer is displaceable relative to support rails 12 which are fastened to the furniture frame.

The support rail 12, which is fastened to the vertical frame member 1 of the frame, is U-shaped and has a vertical web 21, on which track rollers 15 are supported or having a running web 37 for track rollers is constructed, and a vertical fastening web 22 having at a front end thereof a clamping device 13. The support rail 12 projects freely into the furniture carcass. The support rail 12 may have at its rear end a support block 14, by means of which it is supported laterally against a respective side panel 3.

Figure 5:
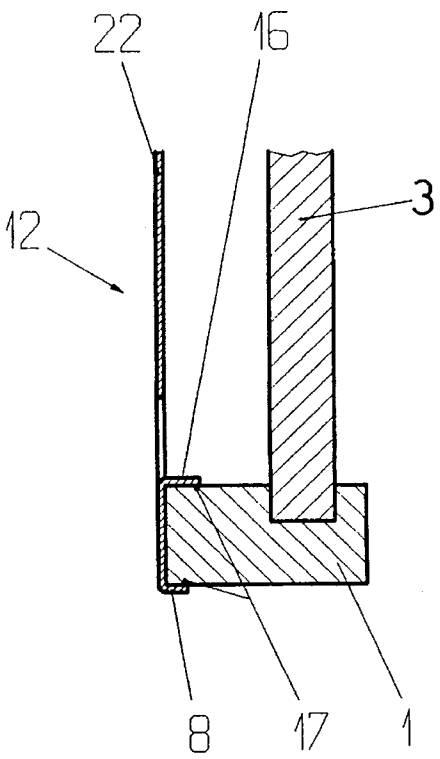
FIG. 5 is a horizontal section through the furniture frame and support rail of FIG. 4.
Figure 4:
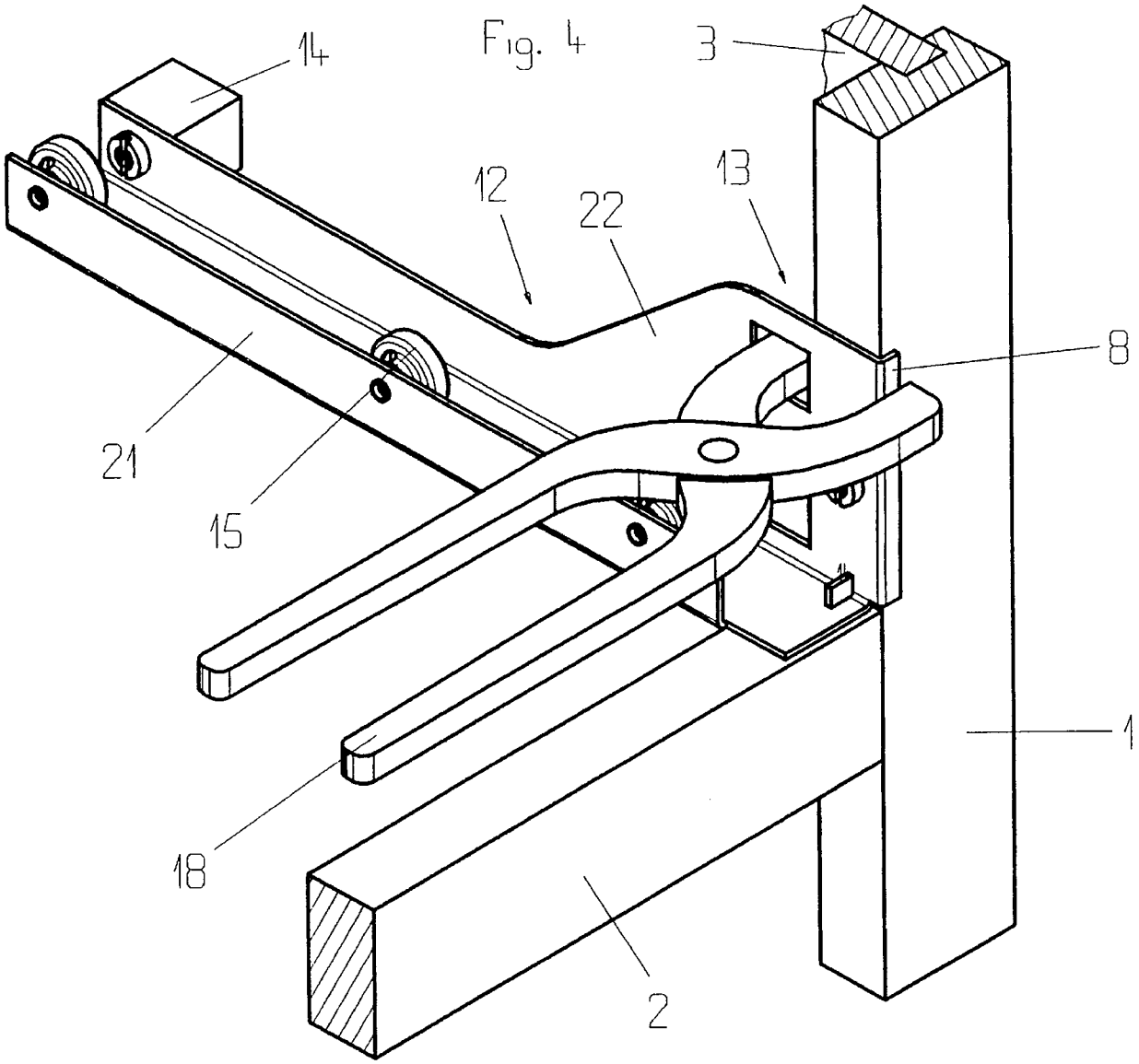
FIG. 4 is a perspective view of a portion of a furniture frame and a support rail which is to be fastened to such frame.
Figure 14:
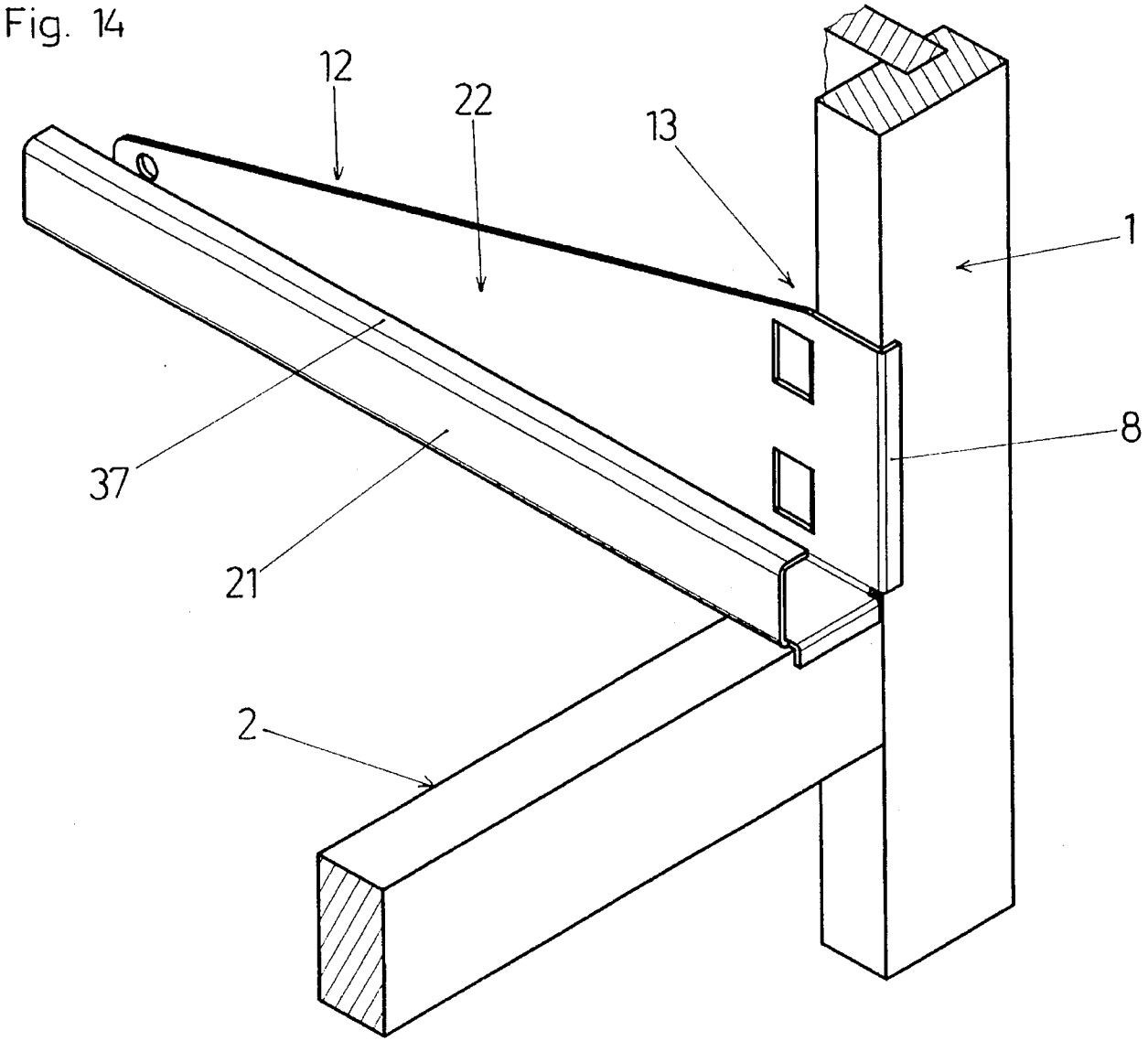
FIG. 14 is a view the same as FIG. 4, but shown without an assembly too1.

In the embodiment according to FIG. 4, 5 and 14 the clamping device 13 comprises a front, rigid stop web 8, which rests from the front against a front surface of the vertical frame 1, and two bendable tabs 16 disposed one above the other and punched out from the material of fastening web 22. Both the stop web 8 and the tabs 16 are provided with spike-like claws 17 which, during the course of mounting of the support rail 12, are pressed into the vertical frame member 1. All that is required to fasten the support rail 12 to the furniture frame is to place the fastening web 22 of the support rail 12 against the vertical frame member 1 in such a way that the stop web 8 rests against the front of the frame member 1. During such process, the tabs 16 have to be bent slightly backwards so that the frame member 1 may easily be accommodated between the stop web 8 and the tabs 16. Once the support rail 12 is situated in the correct position, the tabs 16 are bent with the aid of a pincer-like too1 18 towards the frame member 1, and the support rail 12 is thereby clamped on the frame member 1 with claws projecting into the material thereof.

Figure 7:
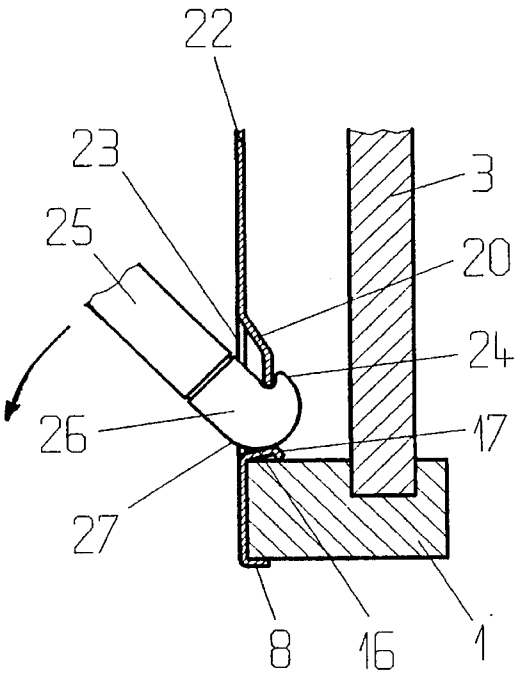
FIG. 7 is a horizontal section through a furniture frame and support rail according to FIG. 6.
Figure 6:
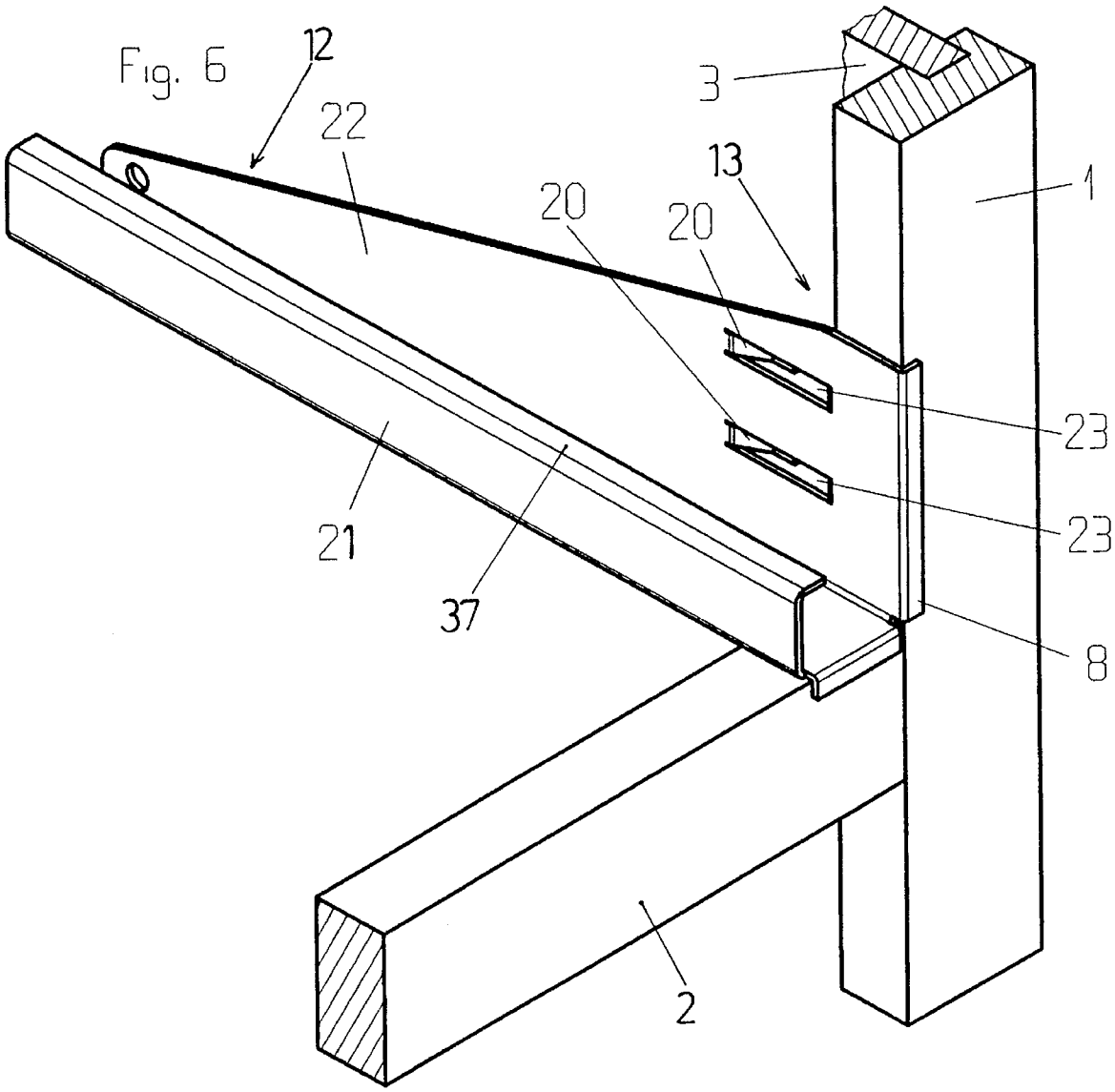
FIG. 6 is a perspective view of a further embodiment of a support rail.
Figure 9:
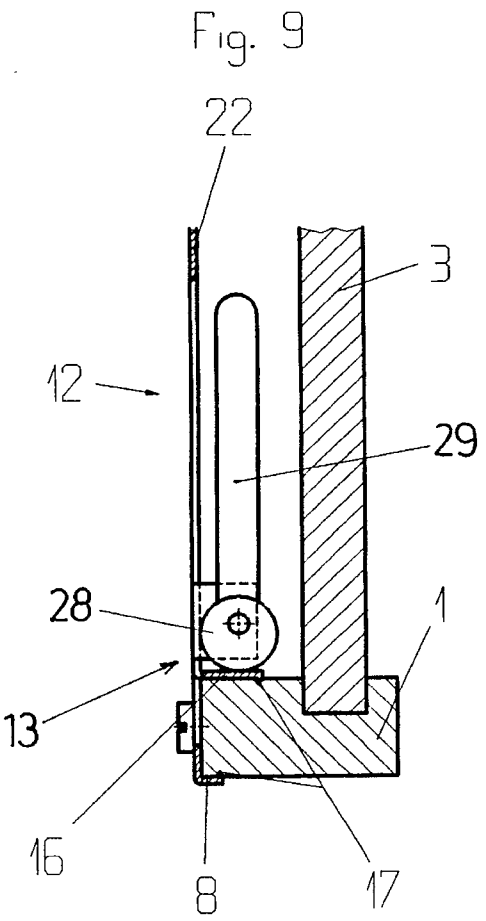
FIG. 9 is a horizontal section through a furniture frame and support rail according to FIG. 8.
Figure 8:
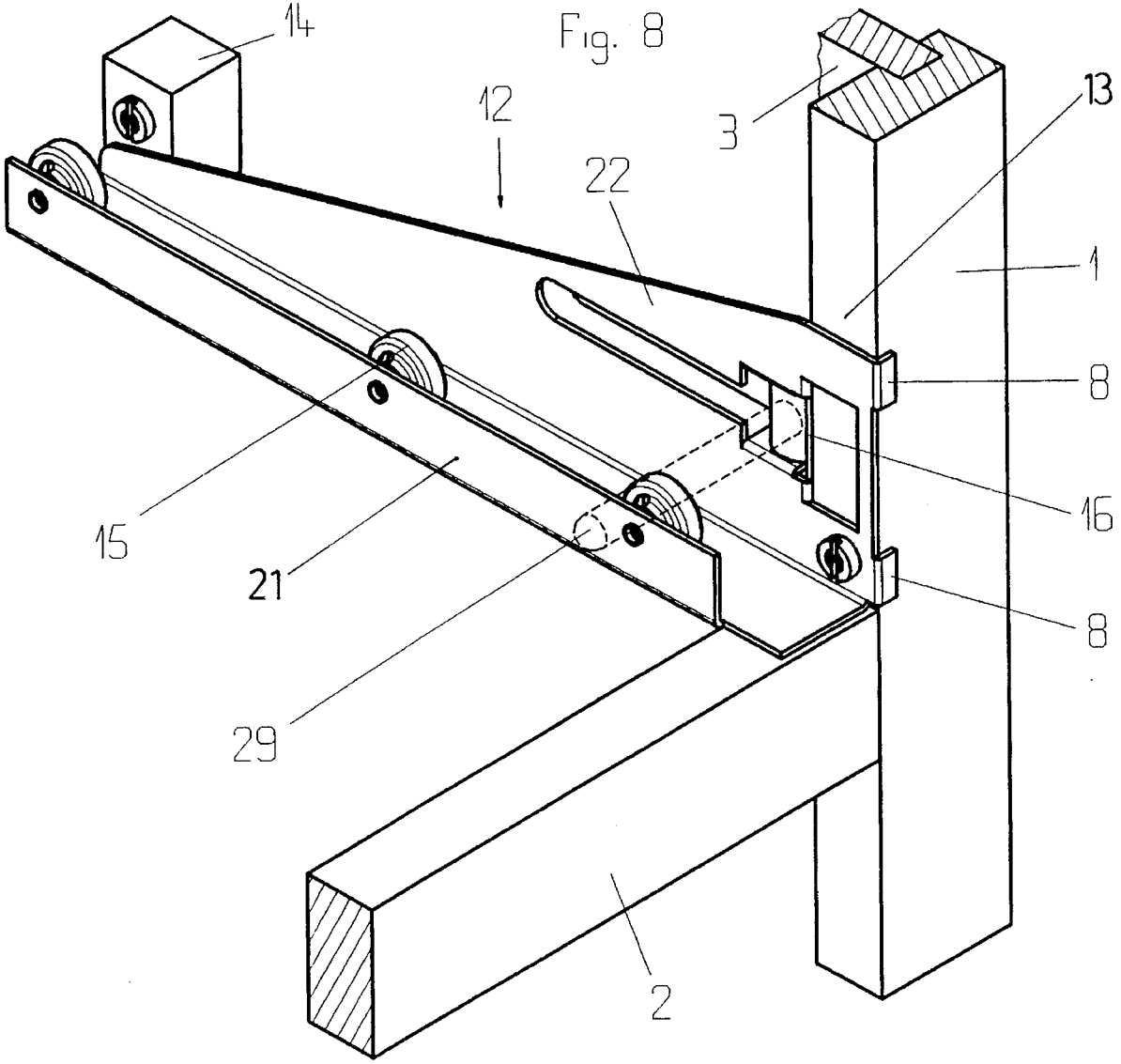
FIG. 8 is a perspective view of a portion of the furniture frame and a further embodiment of a support rail.

In the embodiment according to FIGS. 6 and 7, the support rail 12 is placed in the same manner as in the embodiment previously described against the vertical frame member 1 in such a way that the stop web 8 and the fastening web 22 rest against the frame member 1. Opposite the tabs 16, rigid tongues 20 are bent out from the fastening web 22. To fasten the support rail 12, a lever-like tool 25 is passed through holes 23 in the fastening web 22 and suspended by a notch 24 at the tongues 20. Head 26 of the tool 25 has a curved contact pressure surface 27. By swivelling the tool 25 in the direction of the arrow in FIG. 7, the tabs 16 are pressed against the frame member 1 and the support rail 12 is fastened thereto with the frame member 1 being clamped between web 8 and tabs 16. To prevent the tongues 20 from yielding during movement of the tool 25, they are strengthened, e.g. by stiffening corrugations. In the embodiment according to FIGS. 8 and 9, the fastening web 22 of the support rail 12 is provided at the front thereof with two stop webs 8. For assembly, the support rail 12 is placed against the vertical frame member 1 in the same manner as in the previously described embodiments. Supported in the fastening web 22 of the support rail 12 is an eccentric 28 which, once the support rail 12 is correctly positioned in relation to the frame member 1, presses the tab 16 towards the frame member 1. For such purpose, the eccentric 28 has a lever 29 that is moved from the dashed-line position in FIG. 8 to the solid line position in FIG. 9 to press the tab 16. Between the two stop webs 8 and the tab 16 a three-point bearing support is formed so that a firm, close support of the support rail 12 against the frame member 1 is achieved. The stop webs 8 and he tab 16 again are provided with claws 17.

Figure 10:
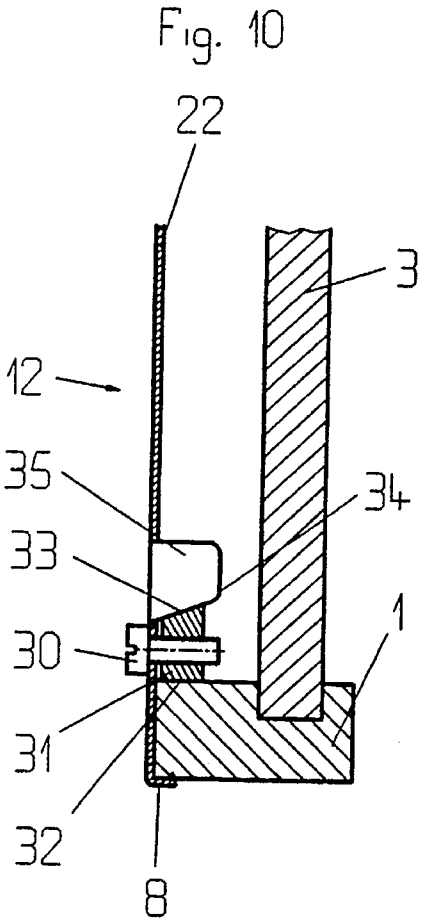
FIG. 10 is a horizontal section through a furniture frame and through a further embodiment of a support rail, only a front end thereof being shown.
Figure 11:
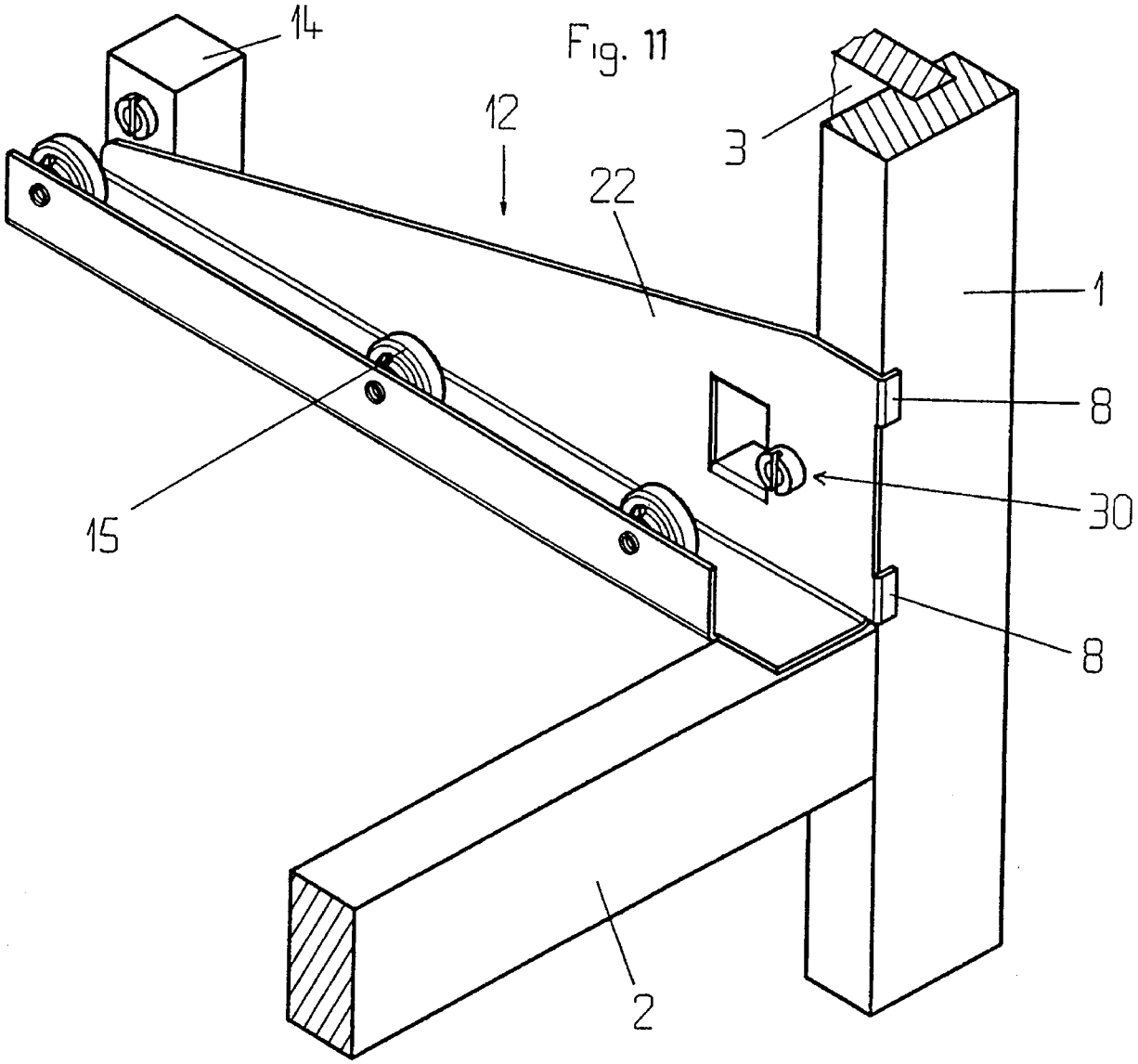
FIG. 11 is a perspective view of the support rail according to FIG. 10.

In the embodiment according to FIGS. 10 and 11, a bolt or screw 30 is supported in the fastening web 22 of the support rail 12. The screw 30 is advantageously supported in an oblong hole in the fastening web 22 or in a hole having a larger diameter than the screw shaft so as to enable a slight movement of the screw 30 away from and towards the stop stop web 8. The screw 30 is screwed into a nut 31. The nut 31 has at one side thereof a contact pressure surface 32, with which, in the assembled position as shown in FIG. 10, it presses against the inside of the frame member 1, and an inclined surface 33 which rests against a support surface 34 of a support block 35. The support block 35 may be formed by one or more tabs punched out from the fastening web 22 of the support rail 12. By turning the screw 30 and tightening the nut 31, the nut 31 may be moved forwards towards the frame member 1. The stop web 8 again is provided with at least one claw 17.

Figure 12:
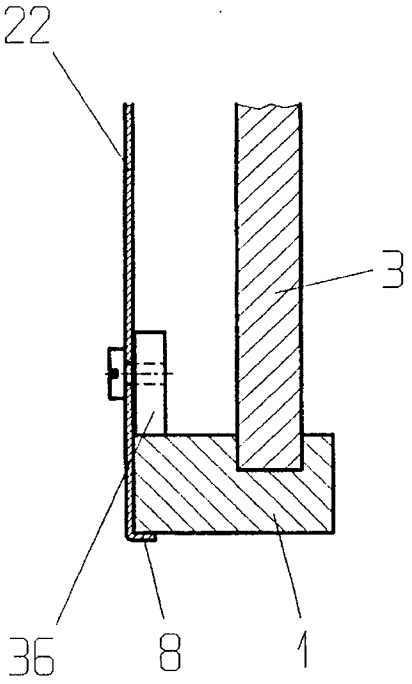
FIG. 12 is a horizontal section through a furniture frame and a further embodiment of a support rail.
Figure 13:
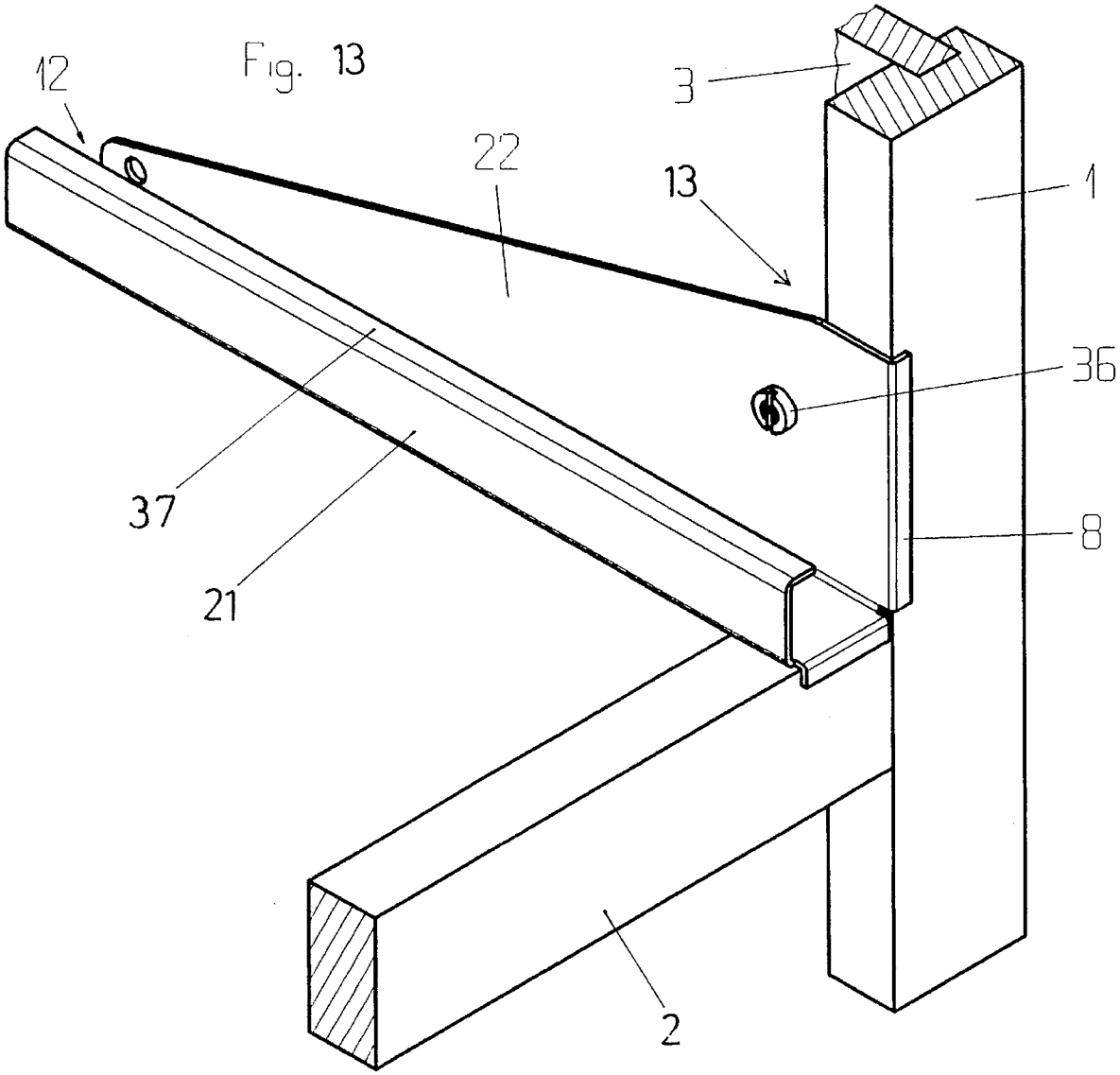
FIG. 13 is a perspective view of the support rail according to FIG. 12.

In the embodiment according to FIGS. 12 and 13, at least one eccentric 36 are supported in the fastening web 22 of the support rail 12. To assemble the support rail 12, said rail is placed against the vertical frame member 1 in the same manner as in the previously described embodiments. Then the eccentric 36 is turned in such a way that the frame strip 1 is clamped between the stop web and the eccentric 36.

We claim:

1. A support rail to be mounted on a vertical frame member of a front frame of an article of frame furniture, said support rail to be part of a pull-out guide for guiding movement of a drawer into and out of the article of furniture, said support rail comprising:

an elongated vertical fastening web;

at least one stop web integral with a front end of said fastening web and projecting laterally therefrom, said stop web forming means to abut a front surface of the vertical frame member when said support rail is mounted thereon;

at least one retaining member on said fastening web at a position spaced in a rearward direction from said stop web, said retaining member having a construction enabling it to be pressed against a rear surface of the vertical frame member when said support rail is mounted thereon; and such that said stop web and said retaining member together form a clamping device with which to embrace the vertical frame member and to mount said support rail thereon without machining thereof.

2. A support rail as claimed in claim 1, wherein said stop web has claws to be pressed into the vertical frame member.

3. A support rail as claimed in claim 1, comprising plural stop webs spaced vertically and projecting laterally from said front end of said fastening web.

4. A support rail as claimed in claim 1, wherein said retaining member comprises at least one tab integral with and punched from said fastening web and bendable therefrom to extend laterally therefrom.

5. A support rail as claimed in claim 4, comprising plural tabs integral with and punched from said fastening web.

6. A support rail as claimed in claim 4, further comprising an eccentric mounted on said fastening web and operable to bend said tab and press said tab against the rear surface of the vertical frame member.

7. A support rail as claimed in claim 4, wherein said tab has claws to be pressed into the vertical frame member.

8. A support rail as claimed in claim 4, further comprising a rigid tongue bent from said fastening web at a position spaced from said tab rearwardly thereof.

9. A support rail as claimed in claim 1, wherein said retaining member comprises at least one eccentric mounted on said fastening web for rotation thereon.

10. A support rail as claimed in claim 1, wherein said retaining member comprises a bolt extending through said fastening web and threadingly engaging a nut having a contact pressure surface operable, upon tightening of said bolt into said nut, to press against the rear surface of the vertical frame member.

11. A support rail as claimed in claim 10, further comprising a support block fixed to said fastening web and having a forwardly inclined support surface, and wherein said nut has a lateral surface inclined complementarily to said inclined support surface and in engagement therewith.

12. A support rail as claimed in claim 11, wherein said bolt extends through an opening in said fastening web with play between said bolt and said fastening web, such that as said bolt is tightened into said nut said inclined lateral surface slides along said inclined support surface and said nut is urged in a direction to be pressed against the rear surface of the vertical frame member.

* * * * *